United States Patent [19]

Benn et al.

[11] Patent Number: 4,781,772

[45] Date of Patent: Nov. 1, 1988

[54] ODS ALLOY HAVING INTERMEDIATE HIGH TEMPERATURE STRENGTH

[75] Inventors: Raymond C. Benn; Andrew Zozom, both of Huntington, W. Va.

[73] Assignee: Inco Alloys International, Inc., Huntington, W. Va.

[21] Appl. No.: 158,874

[22] Filed: Feb. 22, 1988

[51] Int. Cl.[4] ..... C22C 19/05

[52] U.S. Cl. ..... 148/404; 148/410; 148/428

[58] Field of Search ..... 148/404, 410, 428

[56] References Cited

U.S. PATENT DOCUMENTS

| | | | |
|---|---|---|---|
| 3,926,568 | 12/1975 | Benjamin et al. | 29/182.5 |
| 4,209,348 | 6/1980 | Duhl et al. | 148/3 |
| 4,386,976 | 6/1983 | Benn et al. | 148/410 |
| 4,582,548 | 4/1986 | Harris et al. | 148/404 |
| 4,668,312 | 5/1987 | Benn et al. | 148/428 |

FOREIGN PATENT DOCUMENTS

| | | |
|---|---|---|
| 0194683 | 9/1986 | European Pat. Off. . |
| 0196513 | 10/1986 | European Pat. Off. . |

OTHER PUBLICATIONS

"Effect of Processing etc.", Khan et al., Mat. Sci. & Tech., May 1986, vol. 2, pp. 486–492.

"An Atom Probe etc.", Blavette et al., Scripta Metallurgica, vol. 20, No. 10, pp. 1395–1400, 1986.

*Primary Examiner*—R. Dean

*Attorney, Agent, or Firm*—Raymond J. Kenny; Francis J. Mulligan, Jr.

[57] ABSTRACT

Oxide dispersion strengthened alloys containing 5–9% chromium, 5–7% aluminum, 5–9% tungsten, 1–3% molybdenum, 1–5% tantalum, 0–1.5% titanium, 0–10% cobalt, 1–4% rhenium, 0.1–2% yttrium, small amounts of boron and zirconium as required, balance essentially nickel display excellent lives to rupture under load at intermediate high temperatures of about 850° C.

5 Claims, No Drawings

ODS ALLOY HAVING INTERMEDIATE HIGH TEMPERATURE STRENGTH

STATEMENT OF THE ART AND PROBLEM

The present invention is concerned with high temperature resistant nickel-base alloys and, more particularly, with such alloys containing strengthening oxide dispersions and made by mechanical alloying.

In the past, applicant (or applicants' assignee) have disclosed certain alloy compositions made by mechanical alloying which contain strengthening dispersions of oxide containing yttrium and which have, as a chief virtue, useful strength and other mechanical characteristics at very high temperatures about 1093° C. (2000° F.). At such very high temperatures, traditional nickel-base alloys which obtain their strength by a combination of solid solution matrix strengthening and precipitation hardening based upon the formation of gamma prime ($Ni_3Al$) precipitate tend to lose their strength. Essentially the gamma prime precipitate dissolves in the solid matrix metal leaving the alloy with the strength of only the matrix solid solution. Oxide dispersion strengthened (ODS) alloys such as those known as INCONEL® alloy MA754, INCONEL® alloy MA6000 and Alloy 51 retain useful amounts of strength at about 1093° C. but tend to be less strong than some traditional nickel-base alloys, particularly in cast single crystal form, at intermediate high temperatures of about 850° C. (1562° F.). Nominal compositions in percent by weight omitting small effective amounts of boron and/or zirconium of some known ODS alloys are set forth in Table I.

TABLE I

| Element | Alloy: INCONEL Alloy MA754 | INCONEL Alloy MA6000 | Alloy 51 |
|---|---|---|---|
| Ni | Bal. | Bal. | Bal. |
| Cr | 20 | 15 | 9.3 |
| Al | 0.3 | 4.5 | 8.5 |
| Ti | 0.5 | 2.5 | — |
| C | 0.05 | 0.05 | 0.05 |
| W | — | 4.0 | 6.6 |
| Mo | — | 2.0 | 3.4 |
| Ta | — | 2.0 | — |
| $Y_2O_3$* | 0.6 | 1.1 | 1.1 |

*May be present in complex oxidic form with alumina

The problem solved by the present invention is the provision of ODS alloys which retain useful strength at very high temperatures and which approach or exceed the strengths of traditional nickel-base alloys at intermediate high temperatures of about 850° C. This combination of strength characteristics is important in an ODS alloy because the ultimate use of this type of alloy is often in blades and other components in the hot sections of gas turbine engines. Such components do not experience one temperature but rather, usually, a wide range of temperatures while subjected to various stress levels depending generally in part on the configuration of the component. For example, the root portion of a turbine blade will be relatively cool but under a high rotationally induced stress. The leading and trailing edges of the self same blade will generally experience the hottest temperatures existing at a given height level on the blade, with rotationally induced stresses decreasing with height. All in all, an alloy suitable for a gas turbine blade cannot seriously sacrifice strength, ductility, etc. at one temperature for improvement at another temperature without putting severe restraints on the designer of the blade.

OBJECT AND STATEMENT OF THE INVENTION

It is the object of the present invention to provide a new and useful ODS nickel-base alloy which contains, in percent by weight, about 5 to 9% chromium, 5 to 7% aluminum, 5 to 9% tungsten, 1–3% molybdenum, 1–5% tantalum, 0–1.5% titanium, 0–10% cobalt, 1–4% rhenium, 0.6–2% of an oxidic form of yttrium when the alloy is in polycrystalline form and 0.1–1% of an oxidic form of yttrium when the alloy is in single crystal form, 0.005–0.1% boron, 0.03–0.5% zirconium, up to about 2% iron, up to about 0.3% nitrogen, up to about 1% niobium, up to about 2% hafnium, with the balance being essentially nickel. Advantageously, the alloys of the invention contain about 0.03–0.3% zirconium and about 0.005–0.03% boron and are essentially free of niobium and/or hafnium. When in the single crystal form, only the minimum amounts or none of grain boundary segregating elements such as boron, zirconium, carbon and hafnium are contained in the alloy of the invention. The alloy is advantageously in the form of polycrystalline, directionally recrystallized metallic mass, the aspect ratio of the crystals averaging at least about 7 which, subsequent to recrystallization has been heat treated for about 0.5–3 hours at about 1280°–1300° C., air cooled, then held for about 1 to 4 hours at about 940°–970° C., air cooled and held for about 12–48 hours at about 820°–860° C. after which the directionally recrystallized mass is finally air cooled. A most advantageous aspect of the present invention is an alloy composition in which the content of aluminum plus titanium is about 7.5% and/or the rhenium content is about 3%. When these latter criteria are observed, the ODS alloy of the present invention compared to prior nickel-base ODS alloys suffers substantially no disincrement of strength at temperatures over 1000° C. while providing enhanced strength at intermediate temperatures of about 850° C. ODS alloy compositions of the present invention in terms of makeup charge to an attritor or ball mill are set forth in weight percent in TABLE II.

TABLE II

| Element | Alloy: A | B | C |
|---|---|---|---|
| Cr | 8 | 8 | 9 |
| Al | 6.5 | 6.5 | 7 |
| W | 6 | 6 | 6 |
| Mo | 1.5 | 1.5 | 2 |
| Re | 3 | 3 | 3 |
| Ta | 3 | 3 | 1 |
| Ti | — | 1 | — |
| Co | 5 | 5 | — |
| B | 0.01 | 0.01 | 0.01 |
| Zr | 0.15 | 0.15 | 0.15 |
| $Y_2O_3$* | 1.1 | 1.1 | 1.1 |

*May be present in the alloy as yttrium/aluminum garnet or other yttria/alumina product.

Generally speaking, the alloys of the present invention are produced by mechanically alloying powdered elemental and/or master alloy constituents along with oxidic yttrium in an attritor or a horizontal ball mill in the presence of hardened steel balls until substantial saturation hardness is obtained along with thorough interworking of the attrited metals one within another and effective inclusion of an oxide containing yttrium within attrited alloy particles to provide homogeneity. Good results are achieved when the milling charge includes powder of an omnibus master alloy, i.e. an alloy containing all non-oxidic alloying ingredients in proper proportion except being poor in nickel or nickel and cobalt. This omnibus master alloy powder can be produced by melting and atomization, e.g., gas atomization or melt spinning. The mill charge consists of the master alloy plus oxidic yttrium and appropriate amounts of nickel or nickel and cobalt or nickel-cobalt alloy powder. The iron content of the milled alloys of the invention is advantageously limited to 1% maximum an amount which under usual circumstances may be picked up during mechanical alloying processing.

The attrited powder is then screened, blended and packed into mild steel extrusion cans which are sealed and degassed, if required. The sealed cans are then heated to about 1000° C. to 1200° C. and hot extruded at an extrusion ratio of at least about 5 using a relatively high strain rate. After extrusion or equivalent hot compaction, the thus processed mechanically alloyed material can be hot worked, especially directionally hot worked by rolling or the like. This hot working should be carried out rapidly in order to preserve in the metal a significant fraction of the strain energy induced by the initial extrusion or other hot compaction. Once this is done, the alloys of the invention are processed by any suitable means applicable to the solid state, e.g., zone annealing, to provide a coarse elongated grain structure in the body said grains (or grain in the case of a single crystal) having an average grain aspect ratio (GAR) of at least 7. Zone annealing of the alloys of the present invention can advantageously be carried out at temperatures of about 1265°-1308° C. and at differential speeds between a sharply fronted annealing zone and a body of the alloy of the invention of about 50 to 100 mm/hr. For examples reported in the present specification the differential speed of zone annealing was kept constant at about 76 mm/hr. The directional recrystallization temperature was varied and shown to exert an appreciable influence on the bar properties. The approximate recrystallization temperature may be estimated from gradient annealing studies of the unrecrystallized bar. Experience indicates that the secondary recrystallization temperature is associated with the gamma prime solvus temperature in these gamma/gamma prime phase superalloys. Generally the recrystallization temperature is observed to be higher than the gamma prime solvus temperature with the latter perhaps being the lower limit and the incipient melting point being the upper temperature limit. The directional recrystallization response and therefore the ultimate structure/properties of the alloy may, therefore, be infuenced by the directional recrystallization temperature. For example, better high temperature stress rupture properties in alloy B were obtained when the alloy was directionally recrystallized at about 1290° C. (see B1 results in Tables III-/III-A) than at about 1265° C. (see B2 results in Tables III/III-A). The differences in mechanical characteristics are attributed, inter alia, to a more favorable grain aspect ratio and more uniform grain structure obtained when this alloy was directionally recrystallized at 1290° C.

After zone annealing, machining and any other shaping process to achieve final or semi-final product configuration, the alloy of the present invention is heat treated in the solid state by solution annealing at about 1275°-1300° C., e.g. by maintaining 20 mm diameter rod at 1288° C. for one hour followed by air cooling. The alloys are then hardened by heating in the range of about 925°-1000° C. for about 1 to 12 hours, air cooling and then holding at a temperature of about 830°-860° C. for 12-60 hours followed by air cooling. A particularly advantageous heat treatment used in each example reported in this specification comprises solution annealing for 1 hour at 1288° C. followed by heating for 2 hours at 954° C., air cooling and maintaining the alloy at 843° C. for 24 hours prior to final cooling to room temperature.

Stress rupture testing results for alloys A, B and C at various temperatures and stresses are set forth in TABLES III and III-A.

TABLE III

| | Test Condition | | | | | |
|---|---|---|---|---|---|---|
| | 850° C. - 379 MPa | | | 1093° C. - 138 MPa | | |
| Alloy | Life (Hrs) | El % | RA % | Life (Hrs) | El % | RA % |
| A | 508.7 | 1.2 | 2.4 | 8.8 | 0.1 | 3.2 |
| B1 | 1202.4 | 3.1 | 5.1 | 1107.5 | 0.5 | 0.1 |
| B2 | 955.9 | 0.5 | 3.2 | 40.0 | 1.5 | 0.8 |
| C | 771.8 | 3.0 | 6.3 | 904.3 | 2.4 | 0.1 |

TABLE III-A

| | Test Condition | | | | | | | | |
|---|---|---|---|---|---|---|---|---|---|
| | 760° C. - 655 MPa | | | 850° C. - 500 MPa | | | 1093° C. - 165.5 MPa | | |
| Alloy | Life (Hrs) | El % | RA % | Life (Hrs) | El % | RA % | Life (Hrs) | El % | RA % |
| A | 55.8 | 2.9 | 4.0 | 45.3 | 1.2 | 4.3 | 3.8 | 1.3 | 3.9 |
| B1 | 239.0 | 1.2 | 5.5 | 124.4 | 2.5 | 6.3 | 30.9 | 1.4 | 3.1 |
| B2 | 297.1 | 1.1 | 3.1 | 64.1 | 0.7 | 0.8 | 6.7 | 2.0 | 0.8 |
| C | 403.0 | 1.8 | 3.2 | 109.4 | 2.0 | 4.3 | 25 | 1.9 | 3.9 |

The data in TABLES III and III-A shows that the alloys of the present invention have usable lives to rupture under load at 760° C. and 1093° C. and lives to rupture at 850° C. significantly better than such lives to rupture at 850° C. of prior known ODS alloys. For example, given the same heat treatment, Alloy 51 and INCONEL alloy MA6000 lasted for 232.5 and 100 hours respectively at 850° C. under a load of 379 MPa. TABLE III shows that all of the alloys of the present invention lasted at least twice as long as Alloy 51 under these test conditions. The best of the alloys of the present invention, i.e. alloys B and C show lives to rupture under all conditions tested significantly superior to those of Alloy 51 and INCONEL alloy MA6000. At the intermediate high temperature of 850° C. these alloys are capable of lasting 3 to 6 times longer under stress than Alloy 51 and 7 to 12 times longer than INCONEL alloy MA 6000.

While in accordance with the provisions of the statute, there is illustrated and described herein specific embodiments of the invention, those skilled in the art will understand that changes may be made in the form of the invention covered by the claims and that certain features of the invention may sometimes be used to advantage without a corresponding use of the other features.

The embodiments of the invention in which an exclusive property or privilege is claimed are defined as follows:

1. An oxide dispersion strengthened alloy consisting in percent by weight essentially of about 5–9% chromium, 5–7% aluminum, 5–9% tungsten, 1–3% molybdenum, 1–5% tantalum, 0–1.5% titanium, 0–10% cobalt, 1–4% rhenium, 0.6–2% of an oxidic form of yttrium, 0.005–0.1% boron, 0.03–0.5% zirconium, 0–2% iron, 0–0.3% nitrogen, 0–1% niobium, 0–2% hafnium with the balance being essentially nickel, said alloy containing at least about 0.6% of an oxidic form of yttrium when in polycrystalline form and containing near the minimum amount, if any, of grain boundary segregating elements when in single crystal form.

2. An alloy as in claim 1 in the form of a polycrystalline mass having elongated grain structure, the grains of which having an aspect ratio of at least about 7.

3. An alloy as in claim 1 in the form of a monocrystalline mass having a crystal aspect ratio of at least 7.

4. An alloy as in claim 1 containing about 3% rhenium.

5. An alloy as in claim 2 containing about 7.5% total aluminum plus titanium and about 3% rhenium characterized in the age-hardened condition by lives to rupture at 760° C., 850° C. and 1093° C. significantly superior to prior art oxide dispersion hardened nickel-base alloys.

* * * * *